United States Patent [19]

Douillard

[11] Patent Number: 4,549,321

[45] Date of Patent: Oct. 29, 1985

[54] URINAL

[76] Inventor: Roger Douillard, 66 Columbus Ave., Valhalla, N.Y. 10595

[21] Appl. No.: 712,717

[22] Filed: Mar. 18, 1985

[51] Int. Cl.[4] ..... E03D 13/00

[52] U.S. Cl. ..... 4/301; 4/307; 4/312; 4/661

[58] Field of Search ..... 4/301, 144.1, 661, 664, 4/312, 114.1, 307

[56] References Cited

U.S. PATENT DOCUMENTS

| | | | |
|---|---|---|---|
| 3,412,408 | 11/1968 | Michal, Jr. | 4/301 |
| 3,500,480 | 3/1970 | Michal, Jr. | 4/301 |
| 3,822,419 | 7/1974 | Wilson, Sr. | 4/301 X |
| 3,964,110 | 6/1976 | Kapit | 4/301 X |
| 4,282,611 | 8/1981 | O'Day | 4/144.1 |
| 4,490,863 | 1/1985 | Pate | 4/301 |

*Primary Examiner*—Henry K. Artis
*Attorney, Agent, or Firm*—Richard A. Joel

[57] ABSTRACT

A urinal comprises a flattened urinal mounted within a toilet seat cover and a geared lever extending along the periphery of the cover which is coupled to the flatenned urinal. The geared lever engages a gearing arrangement which moves the urinal outwardly from the forward position of the cover while locking the cover in a raised position when the lever has been pulled through an angle of 180 degrees. The urinal opening comprises a funnel-shaped aperture which projects outwardly from the cover and is moved along a track by the gearing arrangement. When the lever is moved back to the closed position, an interconnected flushing valve is activated which sprays a jet of water on the entire inside of the urinal. The urinal retracts into the cover and the cover can be moved up or down.

8 Claims, 8 Drawing Figures

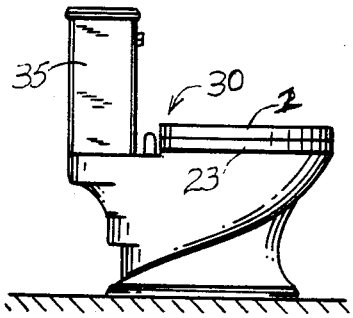
FIG.1
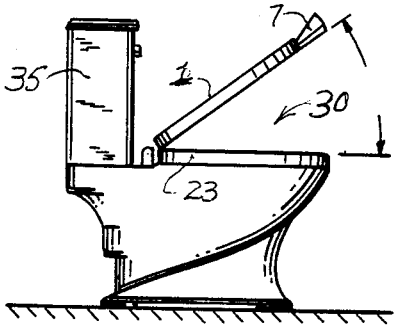
FIG.2
FIG.3
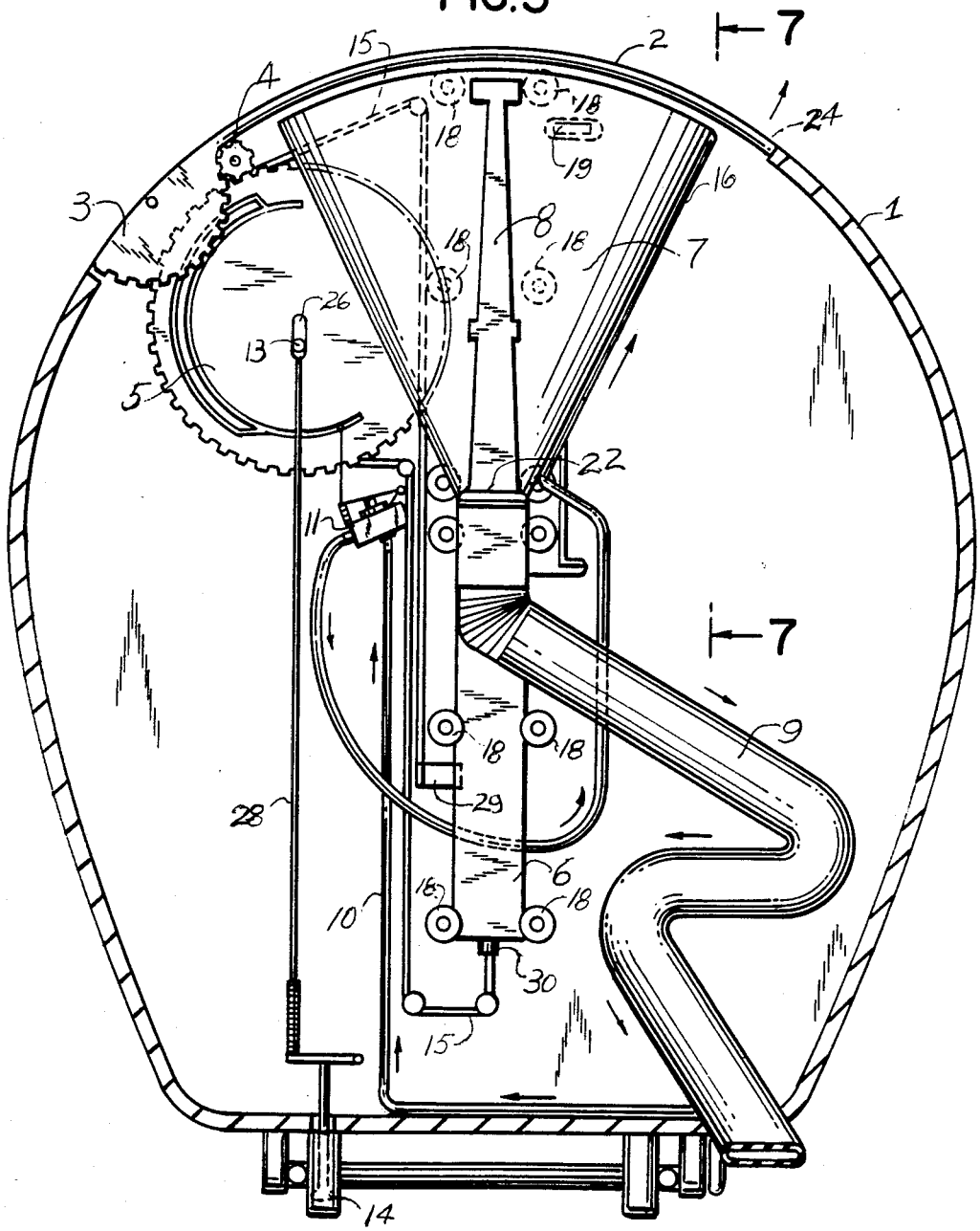

URINAL

BACKGROUND OF INVENTION

This invention relates to waste disposal systems and particularly to a new and improved urinal which is mounted to a toilet seat cover in a compact and convenient arrangement. One lifts the cover and pulls a geared lever on the cover thereby locking the cover in a tilted position and moving a funnel-shaped urinal outwardly from the seat. When the lever is returned to its closed position, it activates a flushing valve which sends a spray of water around the entire inside of the urinal. Using the urinal saves at least six gallons of precious water per flush and eliminates unsanitary urine splatter and odors on rugs and floors. The urinal also eliminates splashing sounds thereby providing more privacy for the individual.

The prior art contains many patents in the waste disposal field and indeed many patents directed specifically to toilets and urinals. One of the closer prior art patents is U.S. Pat. No. 3,448,467 to Smith which discloses a toilet having a separate fecal waste collection receptacle and a urine receptacle mounted on the seat. The seat is pivotal to any desired height to accomodate the user. The system employs an exhaust pump in connection with the receptacles and to draw air therethrough and remove vapors therefrom. The Smith system is structurally and functionally different from the present invention.

In summary, the prior art does not disclose a urinal of the type disclosed herein which is simple, compact and inexpensive. The urinal structure may also be retrofitted to present installations. It does not require separate pumps or unsightly hoses. The design saves water and promotes cleanliness. It is particularly useful in the case of older users where the urine stream may be irregular.

SUMMARY OF INVENTION

The present invention relates to waste disposal systems and particularly to a new type of urinal which may be mounted to a toilet seat cover.

The urinal comprises a pivotal lever which is mounted to the toilet seat cover at one end which includes a geared section engaging a gear system coupled to the means for activating the urinal. The geared lever is moved outwardly 180 degrees after the cover has been lifted and this locks the cover in position and ejects the funnel-shaped urinal from the forward portion of the cover. The gear system includes a locking device which engages a mechanism in the toilet cover to lock the cover in a tilted position and a pulley arrangement which is coupled to a carrier which moves the funnel-shaped urinal outwardly from the forward portion of the cover.

The urinal comprises a funnel-shaped hard rubber member having a collapsable steel support in the outer peripheral portion which folds flat when the urinal is in a retracted position. The rear portion of the rubber member is mounted to a flexible hose-type arrangement which receives the waste urine. When the cover is in a closed position, the hose member is in a bent configuration but becomes straight when the urinal is projecting outwardly from the seat. A lower support member holds the rubber member in a fixed extended position. A flush valve is coupled to the lever to activate a spray when the lever is returned to its initial position. The spray is emitted from a hose member which extends along the periphery of the funnel-shaped member.

In operation the cover on the toilet is raised to a desired height and the geared lever is pulled from across the front edge of the cover through an angle of 180 degrees. The cover is then locked in the desired position and the urinal is forced outwardly from an opening in the forward portion of the seat. The urinal comprises a four inch round rubber funnel-shaped urinal having a steel support along its outer front edge. When the lever is moved back to its closed position, it immediately activates a flushing valve which sends a spray of water along the entire inside of the urinal. The braking device which holds the cover in place is now released and the cover can be moved up or down.

Accordingly, the object of this invention is to provide a new and improved urinal in conjunction with a conventional toilet.

Another object of this invention is to provide a new and improved urinal mounted within a toilet seat which provides a funnel-shaped opening to eliminate unsanitary splashing and odors.

Another object of this invention is to provide a new and improved urinal which provides a separate flushing arrangement in order to save water.

A more specific object of this invention is to provide a new and improved urinal which is mounted within a toilet seat cover and which projects outwardly from the cover in a predetermined variable raised position and may be used to eliminate splashing, odors and save flushing water by providing a separate outwardly projecting funnel-shaped urinal which is conveniently activated and cleansed by a separate flushing arrangement.

BRIEF DESCRIPTION OF THE DRAWINGS

Other objects and advantages of the present invention will be more clearly illustrated when viewed in conjunction with the accompanying drawings wherein:

FIG. 1 is a side view of a toilet showing the invention in a closed position;

FIG. 2 is a side view of a toilet showing the urninal of the present invention in an activated position extending outwardly from the cover;

FIG. 3 is an enlarged cutaway view of the urinal, parts of which are shown in phantom to illustrate the operation thereof;

DETAILED DESCRIPTION OF THE INVENTION

Figure 4:
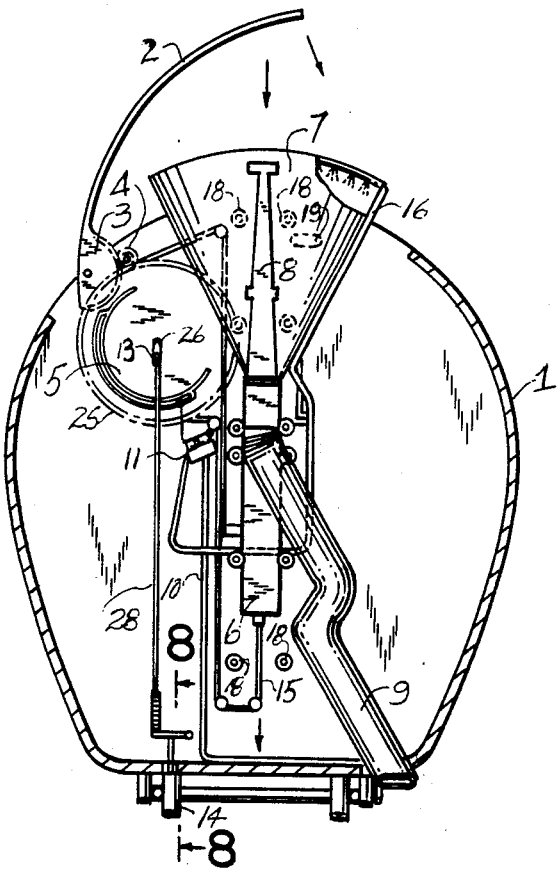
FIG. 4 is a view similar to FIG. 3 showing the operation of the invention as the urinal is activated to project outwardly from the cover.

Referring now to the drawings, the inventin comprises a new type urinal for installation with conventional toilets. As shown in FIG. 1, the urinal 7 is mounted to the cover 1 of a toilet seat 23 on toilet 30. In the inactive state of FIG. 1, the urinal 7 is recessed within the cover 1 and the only portion accessible is the pivotal activating lever 2. To operate the urinal 7, one moves the lever 2 through an angle of 180 degrees while lifting the cover 1 to the desired height. The lever 2 drives the urinal 7 outwardly from the forward position of the cover 1 and locks it in position while simultaneously locking the seat 1 in a raised angular position as shown in FIG. 2. To deactivate the arrangement, the lever 2 is moved back to its original position freeing the cover 1 for movement and driving the urinal 7 into a recess 24 in the cover 1. During the unlocking movement of the lever 2, a flushing valve 11 is activated causing a spray within the urinal.

In greater detail, the lever 2 is of a curved configuration conforming to the contour of the cover 1 in an inactive state. The lever 2 includes a geared position 3 which engages a booster gear 4 having two spaced rows of teeth designed to approximately double the speed of the main gear 5. The main gear 5 meshes with the lower row of teeth on the booster gear and is driven thereby. The gear 5 also includes a groove 25 on its outer edge which engages the operating cables 15 which drive the urinal to and fro with the carrier 6. An off-center pin 13 protrudes through a slot 26 in gear 5 and is connected to a locking device 14 in the seat hinge arm 27 by linkage 28. The locking device comprises a brake-shoe type pad 28 which is driven against the arm 27 to lock the cover 1 in a raised angular position when the geared lever 2 has been rotated through an angle of approximately 135 degrees.

Figure 5:
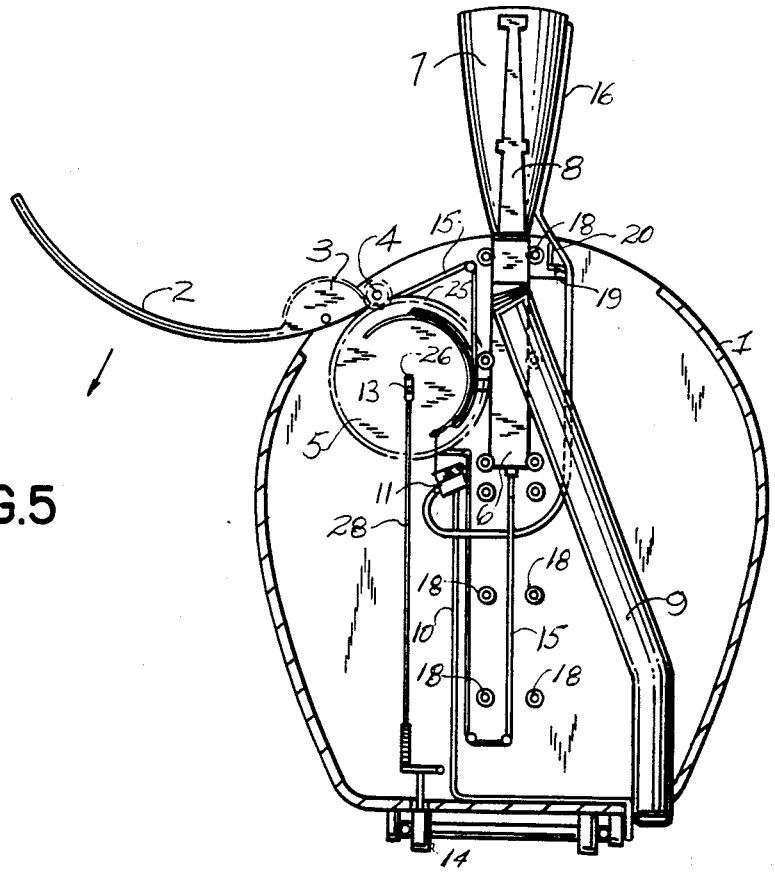
FIG. 5 is a view similar to FIG. 4 showing the urinal in a fully extended position from the cover.

The urinal 7 is mounted to the carrier 6 which slides along a plurality of roller guides 18. The operating cable 15 is connected to the carrier 6 at mountings 29 and 30 to drive the carrier 6 as the main gear 5 is driven by the activating lever 2. The cable passes from the grooved position of the gear 5 over idlers 31 to the carrier mountings 29 and 30. The movement of the carrier is illustrated in FIGS. 4 and 5.

The funnel-shaped urinal 7 is constructed of hard rubber with a flexible steel supporting member 32 comprising a rigid water channel 16 mounted about the outer periphery thereof and extending rearwardly into slot 24. The rear position of the funnel 33 is connected to the mounting 34 which has a flexible waste line 9 coupled thereto. The mounting 34 is located on the carrier 6 for movement back and forth and includes a forwarding extending expander arm 8 connected to the urinal funnel. The expander arm 8 is spring-mounted to the member 34 to keep the urinal 7 tightly closed.

Figure 6:
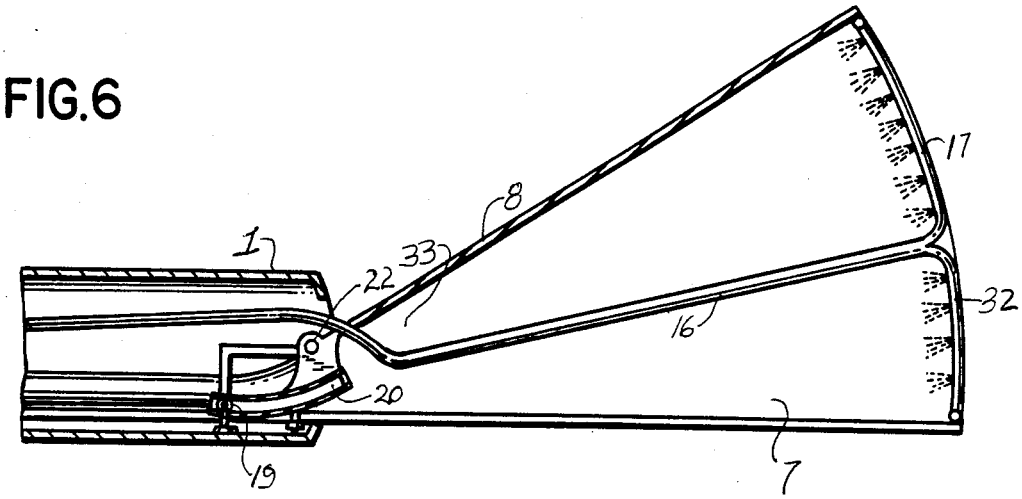
FIG. 6 is a side cross sectional view of the funnel-shaped urinal in a fully extended position taken along the line 6—6 of FIG. 5.
Figure 7:
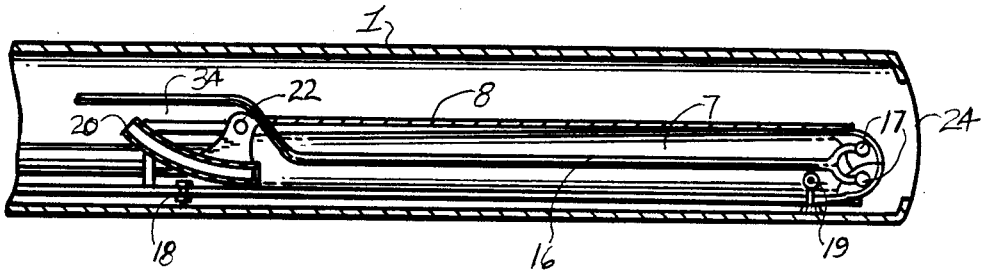
FIG. 7 is a view taken along the line 7—7 of FIG. 3.

As best shown in FIGS. 6 and 7 the ball bearing wheel 19 engages the angled track 20 having the hinged position 22 of the expander arm connected thereto. The expander arm 8 is driven outwardly from slot 24 and expands the urinal 7 into the open locked position of FIG. 6. When the activating lever 2 is moved to its original position the urinal 7 is retracted into the cover 1.

A fresh water supply is fed from the water closet 35 along line 10 and its flexible position 21 to the flush valve 11. The valve 11 is connected to the main gear 5 for activation when the urinal 7 is retracted into the cover 2. The valve 11 opens and permits water to flow through flexible line 21 and through the water channel 16 which is built into the funnel to the two peripheral channels 17. Apertures in the channels 17 provide a spray along the inside of the funnel. Approximately one pint of water is used per flush in contrast with the six gallons of water which are used each time a toilet is flushed.

Figure 8:
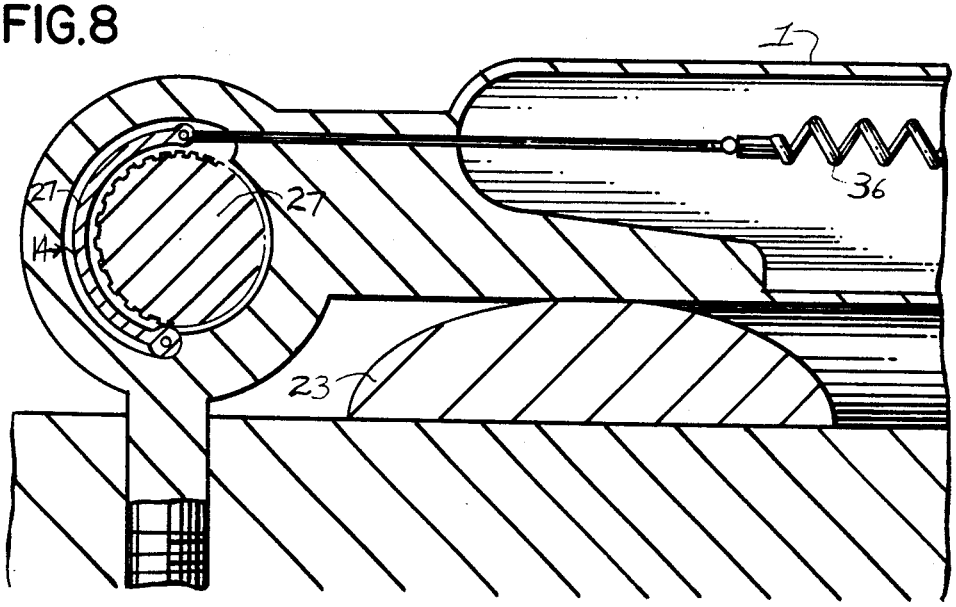
FIG. 8 is a view taken along the line 8—8 of FIG. 4.

FIG. 8 illustrates in greater detail the locking arrangement 14 wherein the hinge arm of the cover is engaged by the brake shoe 29 when the rod 28 having a spring end position 36 is moved in an outward direction. This action locks the cover 1 in a raised position.

In summary, the present invention provides a new and improved urinal 7 which conserves water and eliminates unsightly and unsanitary splatter and odors. The device may be included in new installations or inexpensively retrofitted into existing installations. The relative simplicity of the subject urinal adds to the reliability and life of the design.

It is understood that the above-described arrangements are merely illustrative examples of the application. Numerous other arrangements may be readily devised by those skilled in the art which will embody the principals of the invention and fall within the spirit and scope thereof.

I claim:

1. A urinal mounted in a hinged toilet seat cover and extensible from an aperture therein comprising a collapsible funnel-shaped urinal, a pivotal lever having a gear section at one end mounted to the seat and extending along the forward portion of the seat, a gear system within the cover engaged by the gear section of the lever, a carrier coupled to the rear of the urinal and including a waste line coupled thereto and an extender arm mounted to the urinal to project it outwardly from the seat and into a funnel shape and means to lock the urinal in position, means coupled to the gear system engaging the cover hinge to lock the cover in a raised position, pulley means connected to the gear system at one end and to the carrier to drive the carrier back and forth, and, flushing means connected to the gear system and activated thereby when the pivotal lever is returned to its original position, said means including a flushing line extending about the periphery of the funnel to provide a flushing spray.

2. A urinal in accordance with claim 1 wherein:

the pivotal lever has a curved configuration conforming to the contour of the cover and said lever activates the urinal when the lever is moved through an angle of 180 degrees.

3. A urinal in accordance with claim 1 wherein:

the gear system comprises a booster gear having an upper and a lower series of teeth, the upper series of teeth engaging the gear section of the lever and, a main gear engaged by the lower section of teeth to increase the speed of the main gear; said gear having an elongated off-center slot therein and a pin protruding therefrom.

4. A urinal in accordance with claim 3 wherein:

the main gear comprises an upper peripheral toothed portion engaging the booster gear and a lower grooved portion having cable means wrapped thereabout to drive the carrier, and the cable means comprises a cable and a plurality of idlers engaging said cable at predetermined interervals, and, mounting means affixing each end of the cable to a different predetermined location on the carrier to drive said carrier back and forth.

5. A urinal in accordance with claim 1 wherein:

the cover locking means comprises a linkage connected to one end to the pin in the main gear and having a spring portion at the other end, a curved brake pad connected to the spring portion and a covered hinge arm having a toothed surface engaged by the brake pad to lock the cover in a raised position.

6. A urinal in accordance with claim 1 wherein:

the carrier includes a supporting hinge arm mounted to the funnel-shaped urinal, an angled track and a ball bearing wheel which engages the track raising the urinal into a raised position.

7. A urinal in accordance with claim 6 further including:

roller bearings mounted to the cover to guide the carrier and a flexible waste line mounted to the rear of the funnel-shaped urinal.

8. A urinal in accordance with claim 1 wherein:

the flushing means comprises an inlet water line, a valve connected to the inlet line and activated by the main gear and a flexible outlet line, a rigid line connected thereto at one end and mounted along the length of the funnel and having a peripheral apertured portion extending about the funnel opening for flushing purposes.

* * * * *